US008175840B2

(12) United States Patent
Hwang et al.

(10) Patent No.: US 8,175,840 B2
(45) Date of Patent: May 8, 2012

(54) APPARATUS OF TRACKING POSTURE OF MOVING MATERIAL OBJECT, METHOD OF TRACKING POSTURE OF MOVING MATERIAL OBJECT, APPARATUS OF CHASING POSTURE OF TOOTHBRUSH AND METHOD OF TRACKING POSTURE OF TOOTHBRUSH USING THE SAME

(75) Inventors: Jin Sang Hwang, Suwon-si (KR); Jeong-Whan Lee, Chungju-si (KR)

(73) Assignee: Jin Sang Hwang, Suwon-Si (KR)

( * ) Notice: Subject to any disclaimer, the term of this patent is extended or adjusted under 35 U.S.C. 154(b) by 401 days.

(21) Appl. No.: 12/450,559

(22) PCT Filed: Nov. 7, 2008

(86) PCT No.: PCT/KR2008/006561

§ 371 (c)(1),
(2), (4) Date: Sep. 30, 2009

(87) PCT Pub. No.: WO2009/066891

PCT Pub. Date: May 28, 2009

(65) Prior Publication Data

US 2010/0145654 A1 Jun. 10, 2010

(30) Foreign Application Priority Data

Nov. 19, 2007 (KR) ..... 10-2007-0117688

(51) Int. Cl.
*G01C 9/00* (2006.01)
*G01C 9/14* (2006.01)

(52) U.S. Cl. ..... 702/153; 15/105; 340/539.11; 434/263; 702/158

(58) Field of Classification Search ..... 702/94, 702/97, 150–153, 158, 163, 175; 15/105; 345/158, 169; 356/614; 434/263; 600/118; 701/36, 41, 48, 70, 71, 90, 91; 340/539.11
See application file for complete search history.

(56) References Cited

U.S. PATENT DOCUMENTS

| | | | | |
|---|---|---|---|---|
| 6,536,068 | B1 | 3/2003 | Yang et al. | |
| 6,786,732 | B2 | 9/2004 | Savill et al. | |
| 7,450,002 | B2 * | 11/2008 | Choi et al. | 340/539.11 |
| 2005/0256675 | A1 * | 11/2005 | Kurata | 702/153 |

FOREIGN PATENT DOCUMENTS

| | | |
|---|---|---|
| JP | 2005-152217 | 6/2005 |
| WO | 2006/137648 | 12/2006 |

OTHER PUBLICATIONS

Kyeong-Seop Kim, et al., "Interactive toothbrushing education by a smart toothbrush system via 3D visualization", Computer Methods and Programs in Biomedicine, vol. 96, pp. 125-132, 2009.
International Search Report issued on Jun. 22, 2009 in PCT Application No. PCT/KR2008/006561.

* cited by examiner

*Primary Examiner* — John H Le
(74) *Attorney, Agent, or Firm* — Staas & Halsey LLP

(57) ABSTRACT

An apparatus for tracking an posture of a moving object in a three-dimensional space having a z-axis facing a reference surface of the moving object, an x-axis perpendicular to the z-axis in a virtual vertical plane including the z-axis, and a y-axis perpendicular to the x-axis in a virtual horizontal plane including the x-axis is described. A reference surface direction determination unit detects which direction the reference surface is facing with the x-axis as an axis of rotation. The x-axis deviation determination unit detects how far an x-axis direction of the moving object is relatively deviated from a magnetic north direction. The determination unit determines the posture of the moving object based on how far the x-axis of the moving object is deviated and which direction the reference surface is facing in response to detection signals of the reference surface direction determination unit and the x-axis deviation determination unit.

7 Claims, 11 Drawing Sheets

APPARATUS OF TRACKING POSTURE OF MOVING MATERIAL OBJECT, METHOD OF TRACKING POSTURE OF MOVING MATERIAL OBJECT, APPARATUS OF CHASING POSTURE OF TOOTHBRUSH AND METHOD OF TRACKING POSTURE OF TOOTHBRUSH USING THE SAME

CROSS REFERENCE TO RELATED PATENT APPLICATIONS

This application claims the benefit under 35 U.S.C. Section 371, of PCT International Application No. PCT/KR2008/006561, filed Nov. 7, 2008, which claimed priority to Korean Patent Application No. 10-2007-0117688, filed Nov. 19, 2007 in the Korean Intellectual Property Office, the disclosures of which are hereby incorporated by reference.

TECHNICAL FIELD

The present invention relates to an apparatus for tracking the posture of a moving object, and more particularly to an apparatus for tracking the posture of a moving object including a triaxial accelerometer and a terrestrial magnetism sensor, a method of tracking the posture of a moving object, an apparatus for tracking the posture of a toothbrush, and a method of tracking the posture of a toothbrush using the same.

BACKGROUND ART

An accelerometer sensor, an angular speed sensor, a terrestrial magnetism sensor and so on are combined to determine the posture of a moving object.

However, the conventional art has an inconvenience in that an initial value should be set at a corresponding position according to the movement of the moving object because a reference direction of terrestrial magnetism is set when the terrestrial magnetism sensor is used.

Recently, several products applying posture tracking technology have been introduced. Particularly, a correction toothbrush for correcting wrong toothbrushing habits by tracking the posture of a toothbrush is not widespread because complex and expensive sensors are combined in the correction toothbrush so as to determine a precise posture, and thus manufacturing costs may be too high.

Therefore, a system diagnosing toothbrushing habits and a technology analyzing toothbrushing patterns and so on have been suggested; however, a technology capable of tracking the movement of a toothbrushing of a user, which should take precedence over the system diagnosing the toothbrushing habits and the technology analyzing the toothbrushing patterns, is insufficient, and thus the technology capable of tracking the movement of the toothbrushing of the user is required.

DISCLOSURE

Technical Problem

The present invention provides an apparatus for tracking the posture of a moving object including a triaxial accelerometer and a terrestrial magnetism sensor and a method of tracking the posture of a moving object.

The present invention also provides an apparatus for tracking the posture of a toothbrush, and a method of tracking the posture of a toothbrush using an apparatus for tracking the posture of a moving object.

Technical Solution

In some embodiments of the present invention, an apparatus for tracking the posture of a moving object in a three-dimensional space having a z-axis facing a reference surface of the moving object, an x-axis perpendicular to the z-axis in a virtual vertical plane including the z-axis, and a y-axis perpendicular to the x-axis in a virtual horizontal plane including the x-axis, includes a reference surface direction determination unit, an x-axis deviation determination unit and a determination unit. The reference surface direction determination unit detects in real time which direction of up, down, left and right the reference surface is facing with the x-axis as an axis of rotation. The x-axis deviation determination unit detects in real time how far an x-axis direction of the moving object is relatively deviated from a magnetic north direction. The determination unit determines the posture of the moving object based on how far the x-axis of the moving object is deviated and which direction of up, down, left and right the reference surface is facing in response to detection signals of the reference surface direction determination unit and the x-axis deviation determination unit.

The reference surface direction determination unit may include a triaxial accelerometer and the x-axis deviation determination unit may include a terrestrial magnetism sensor.

The triaxial accelerometer may measure a pitch angle and a roll angle.

The x-axis deviation determination unit may further include a sorter for sorting output data of the terrestrial magnetism sensor.

The sorter may perform one of fuzzy clustering, a neural network and a k-means algorithm.

In a method of tracking the posture of a moving object according to an example embodiment of the present invention, which direction of up, down, left and right a reference surface is facing with an x-axis as an axis of rotation is detected in real time How far an x-axis direction of the moving object is relatively deviated from a magnetic north direction is detected in real time. The posture of the moving object is determined based on how far the x-axis of the moving object is deviated and which direction of up, down, left and right the reference surface is facing in response to the detected reference surface direction detection signal and the detected x-axis deviation detection signal.

In some embodiments of the present invention, an apparatus for tracking the posture of a toothbrush includes a triaxial accelerometer, a terrestrial magnetism sensor and a determination unit so as to track the posture of the toothbrush in a three-dimensional oral cavity having a direction toothbrush bristles are facing, a toothbrush handle length direction perpendicular to the direction the toothbrush bristles are facing in a virtual vertical plane including an axis of the direction the toothbrush bristles are facing, and a toothbrush bristle shaking direction perpendicular to the toothbrush handle length direction in a virtual horizontal plane including the toothbrush handle length direction. The triaxial accelerometer detects in real time which direction of up, down, left and right in an oral cavity the toothbrush bristles are facing with the toothbrush handle length direction as an axis of rotation. The terrestrial magnetism sensor detects in real time how far the toothbrush handle length direction is relatively deviated in the oral cavity from a magnetic north direction. The determination unit determines which tooth portion is currently being brushed by the toothbrush bristles by determining how far a toothbrush handle of the toothbrush is relatively deviated from the magnetic north direction and which direction of up, down, left and right the toothbrush bristles are facing in response to detection signals of the triaxial accelerometer and the terrestrial magnetism sensor.

The determination unit may operate by dividing teeth into 16 tooth portions, such as an outer surface of lower front teeth, an inner surface of lower front teeth, an outer surface of lower left molars, an inner surface of lower left molars, an upper surface of lower left molars, an outer surface of lower right molars, an inner surface of lower right molars, an upper surface of lower right molars, an outer surface of upper front teeth, an inner surface of upper front teeth, an outer surface of upper left molars, an inner surface of upper left molars, a lower surface of upper left molars, an outer surface of upper right molars, an inner surface of upper right molars, a lower surface of upper right molars, etc.

In a method of tracking the posture of a toothbrush according to an example embodiment of the present invention, which direction of up, down, left and right in an oral cavity the toothbrush bristles are facing with the toothbrush handle length direction as an axis of rotation is detected in real time using a triaxial accelerometer. How far the toothbrush handle length direction is relatively deviated in the oral cavity from a magnetic north direction is detected in real time using a terrestrial magnetism sensor. Which tooth portion is currently being brushed by the toothbrush bristles is determined by determining how far a toothbrush handle of the toothbrush is relatively deviated from the magnetic north direction and which direction of up, down, left and right the toothbrush bristles are facing in response to detection signals of the triaxial accelerometer and the terrestrial magnetism sensor.

Advantageous Effects

An apparatus for tracking the posture of a moving object of the present invention may precisely detect the posture of a toothbrush anywhere on the earth using an accelerometer and a terrestrial magnetism sensor, and thus may decrease manufacturing costs, and the apparatus for tracking the posture of the moving object of the present invention may be used without setting a terrestrial magnetism sensor according to a position on the earth, and thus the apparatus for tracking the posture of the moving object of the present invention may increase convenience of use.

BEST MODE

Mode for Invention

Figure 1:
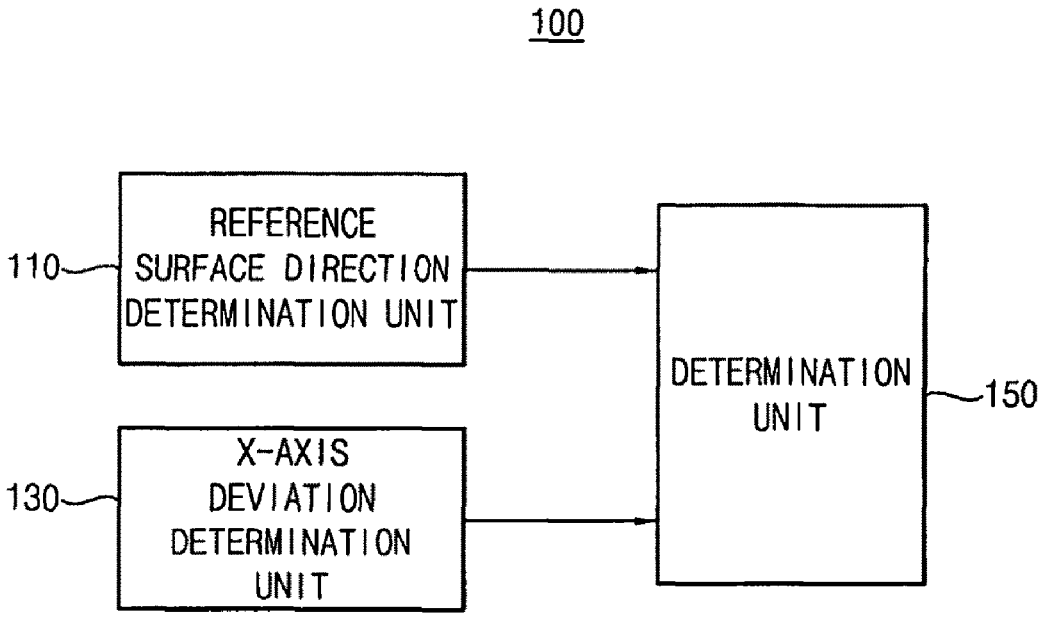
FIG. 1 is a block diagram illustrating an apparatus for tracking the posture of a moving object according to an example embodiment of the present invention.

Embodiments of the present invention now will be described more fully with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Hereinafter, the present invention will be described in detail with reference to the accompanying drawings.

FIG. 1 is a block diagram illustrating an apparatus for tracking the posture of a moving object according to an example embodiment of the present invention.

The apparatus 100 for tracking the posture of the moving object defines a three-dimensional space having a z-axis facing a reference surface, an x-axis perpendicular to the z-axis in a virtual vertical plane including the z-axis, and a y-axis perpendicular to the x-axis in a virtual horizontal plane including the x-axis.

Referring to FIG. 1, the apparatus 100 for tracking the posture of the moving object includes a reference surface direction determination unit 110, an x-axis deviation determination unit 130 and a determination unit 150.

The reference surface direction determination unit 110 detects and determines in real time which direction of up, down, left and right a reference surface of the moving object is facing with the x-axis as an axis of rotation using a triaxial direction having the z-axis, the x-axis and the y-axis. The x-axis deviation determination unit 130 detects and determines in real time how far an x-axis direction of the moving object is relatively deviated from a magnetic north direction. The determination unit 150 determines the posture of the moving object based on the direction the reference surface of the moving object is facing, which is determined by the reference surface direction determination unit 110, and how far the x-axis of the moving object is deviated, which is determined by the x-axis deviation determination unit 130. The reference surface direction determination unit 110 including a triaxial accelerometer detects which direction of up, down, left and right (a z-axis direction or a y-axis direction) the reference surface is facing with the x-axis as an axis of rotation. That is, the reference surface direction determination unit 110 detects whether or not a reference surface of the moving object has an posture facing a specific surface of an object with a specific reference axis as an axis of rotation when the moving object faces the object.

The x-axis deviation determination unit 130 including a terrestrial magnetism sensor detects how far the x-axis direction of the moving object is relatively deviated from the magnetic north direction.

The apparatus 100 for tracking the posture of the moving object illustrated in FIG. 1 may be applied to an apparatus for tracking the posture of a toothbrush according to a toothbrushing, an apparatus for tracking the posture of a robot arm, an apparatus for tracking the flight posture of a micro observation airplane, an apparatus for tracking the posture of a deep sea submarine, an apparatus for tracking the flight posture of a rocket according to the topography and natural features of the earth, and an apparatus for tracking the posture of an artificial satellite.

Figure 2:
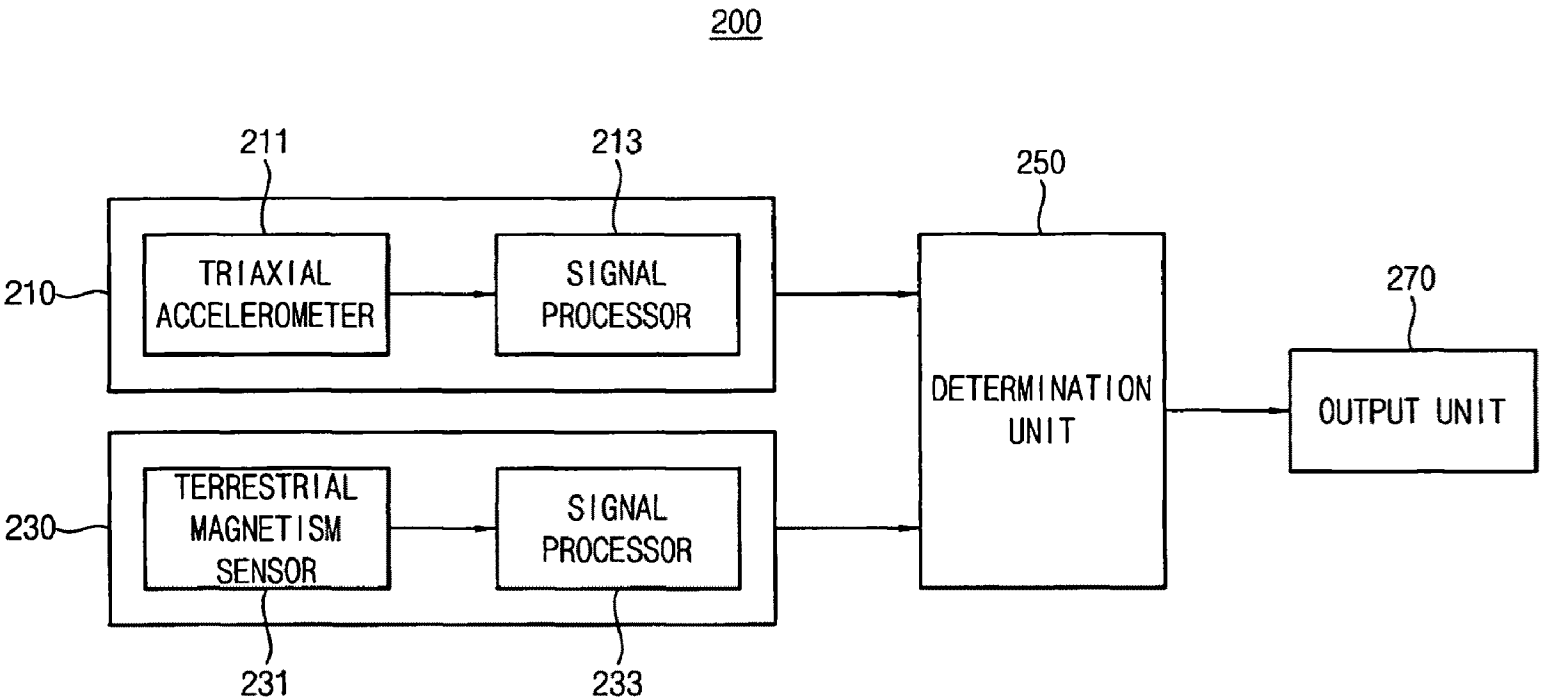
FIG. 2 is a block diagram illustrating an apparatus for tracking the posture of a toothbrush applying an apparatus for tracking the posture of a moving object according to an example embodiment of the present invention.

FIG. 2 is a block diagram illustrating an apparatus for tracking the posture of a toothbrush applying an apparatus for tracking the posture of a moving object according to an example embodiment of the present invention.

Referring to FIG. 2, an apparatus 200 for tracking the posture of a toothbrush includes a reference surface direction determination unit 210, an x-axis deviation determination unit 230 and a determination unit 250.

The reference surface direction determination unit 210 includes a triaxial accelerometer 211 and a signal processor 213. The triaxial accelerometer 211 detects in real time which direction of up, down, left and right, that is, an outer surface of teeth, an inner surface of teeth, an upper surface of lower teeth and a lower surface of upper teeth, toothbrush bristles are facing with a toothbrush handle length direction as an axis of rotation using a triaxial direction. The signal processor 213 determines a toothbrush bristle direction by analyzing a signal detected from the triaxial accelerometer 211. The x-axis deviation determination unit 230 includes a terrestrial magnetism sensor 231 and a signal processor 233. The terrestrial magnetism sensor 231 detects in real time how far a toothbrush handle length direction is relatively deviated (for example, a direction parallel with a left molar tooth, a direction parallel with a right molar tooth, a direction parallel with a front tooth, etc.) from a magnetic north direction. The determination unit 250 determines a toothbrush handle posture related to a length direction according to a degree relatively deviated from the magnetic north direction of the earth in a specific direction of a toothbrush based on detection signals of the reference surface direction determination unit 210 and the x-axis deviation determination unit 230. The posture of the toothbrush is changed according to a portion of a teeth brushed by the toothbrush, and thus a user of the toothbrush may determine which portion of the teeth is brushed using the toothbrush posture determined by the apparatus 200 for tracking the posture of the toothbrush. Also, the apparatus 200 for tracking the posture of the toothbrush may further include an output unit 270 for displaying information of the toothbrush posture determined by the determination unit 250 and outputting to an exterior toothbrushing movement analysis apparatus (not shown) connected to the apparatus 200 for tracking the posture of the toothbrush.

Figure 3:
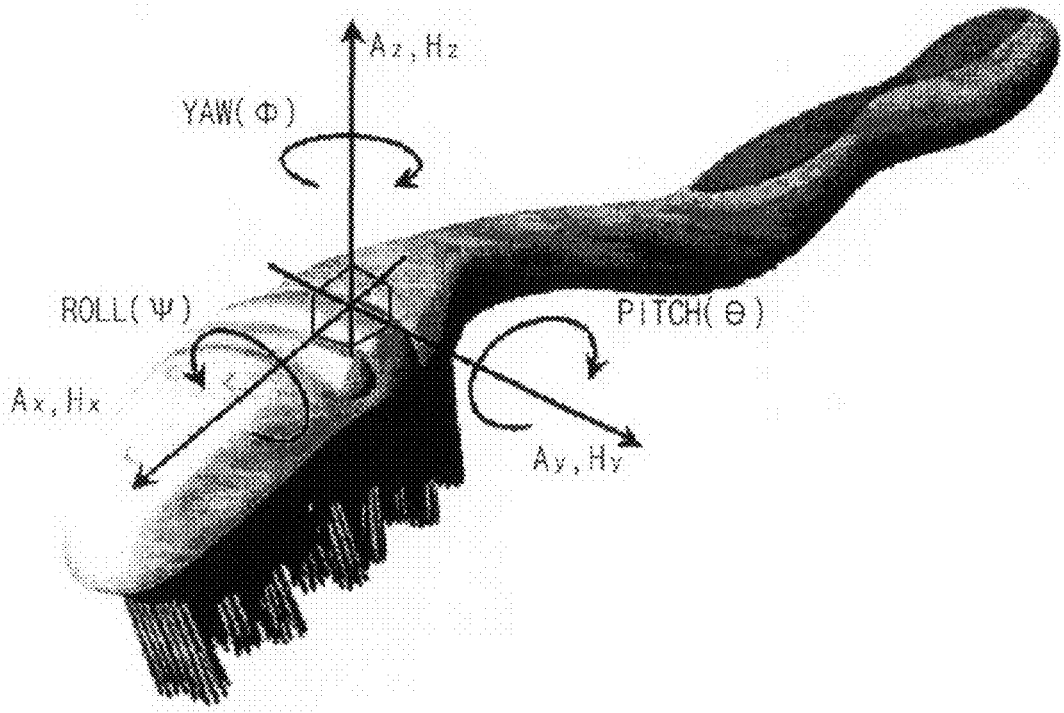
FIGS. 3 and 4 are model diagrams for illustrating a method of detecting a state of which direction of up, down, left and right toothbrush bristles are facing with an axis of a toothbrush handle length direction as an axis of rotation using a reference surface direction determination unit.
Figure 4:
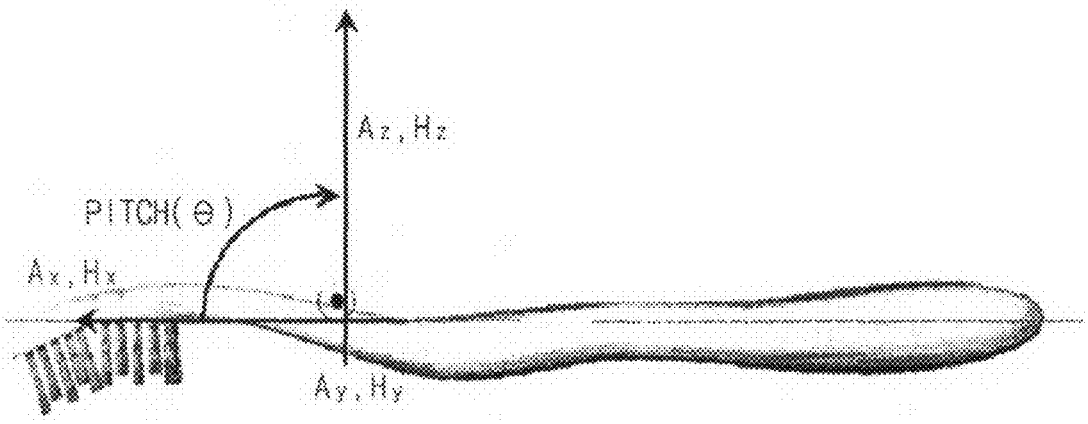

FIGS. 3 and 4 are model diagrams for illustrating a method of detecting a state of which direction of up, down, left and right toothbrush bristles are facing with an axis of a toothbrush handle length direction as an axis of rotation using a reference surface direction determination unit.

Referring to FIGS. 3 and 4, a triaxial accelerometer included in a reference surface direction determination unit measures a pitch angle, a yaw angle and a roll angle of a toothbrush put on an Euler axis, that is, a pitch axis, a yaw axis and a roll axis. Among the pitch angle, the yaw angle and the roll angle, the triaxial accelerometer detects which direction toothbrush bristles are facing by detecting which direction of up, down, left and right the toothbrush bristles are facing based on a change of the roll angle according to a toothbrushing of a user.

However, a change of the roll angle may be detected to be smaller than a real value because a change of the pitch angle changes a gravity value projected in the roll axis. Therefore, the value of the roll angle may be calculated by the following Equation 1 used in a navigation apparatus system.

$$\theta = \sin^{-1}\left(\frac{A_x}{g}\right) \quad \text{[Equation 1]}$$

-continued $$\Psi = \sin^{-1}\left(\frac{-A_y}{g\cos\theta}\right)$$

FIGS. 5, 6, 7 and 8 are model diagrams for illustrating a method of determining which direction of up, down, left and right toothbrush bristles are facing using a reference surface direction determination unit according to an example embodiment of the present invention.

Referring to FIGS. 5, 6, 7 and 8, a change of a roll angle is larger when a side surface of a tooth is brushed with toothbrush bristles are inclined to a left side or a right side than the change of the roll angle when the toothbrush bristles are inclined to an upper side or a lower side because the toothbrush performs a rotary motion when the toothbrush bristles are inclined to the left side or the right side and the side surface of the tooth is brushed. A maximum average value obtained through an experiment is ψL, ψR=60, ψD, ψU=30. Therefore, the reference surface direction determination unit may detect and determine which direction of up, down, left and right the toothbrush bristles are facing, based on the roll angle and the pitch angle measured by a triaxial accelerometer.

Figure 9:
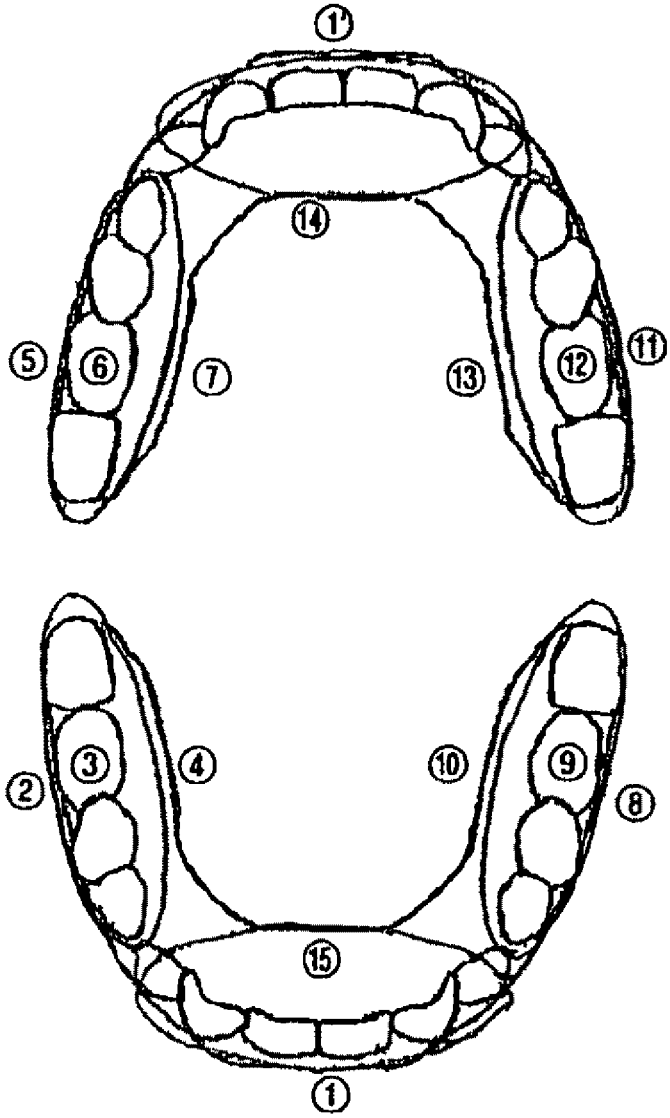
FIG. 9 is a model diagram of teeth for illustrating each portion of the teeth.

FIG. 9 is a model diagram of teeth for illustrating each portion of the teeth.

Referring to FIG. 9, the teeth is divided into portions including an outer surface of lower front teeth 1, an inner surface of lower front teeth 15, an outer surface of lower left molars 8, an inner surface of lower left molars 10, an upper surface of lower left molars 9, an outer surface of lower right molars 2, an inner surface of lower right molars 4, an upper surface of lower right molars 3, an outer surface of upper front teeth 1', an inner surface of upper front teeth 14, an outer surface of upper left molars 11, an inner surface of upper left molars 13, a lower surface of upper left molars 12, an outer surface of upper right molars 5, an inner surface of upper right molars 7, and a lower surface of upper right molars 6.

Figure 5:
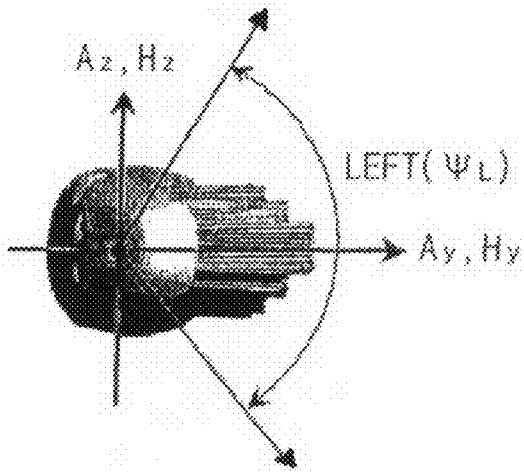
FIGS. 5, 6, 7 and 8 are model diagrams for illustrating a method of determining a state of which direction of up, down, left and right is facing toothbrush bristles using a reference surface direction determination unit according to an example embodiment of the present invention.

When only the direction the toothbrush bristles are facing, which is determined by the reference surface direction determination unit 210, is considered, the precise posture of a toothbrush may not be known, and thus which portion of teeth is brushed may not be precisely known. For example, when a toothbrush is inclined to a left side as illustrated in FIG. 5, the outer surface of lower left molars 8, the outer surface of lower front teeth 1 and the inner surface of lower right molars 4 may be brushed. That is, only the reference surface direction determination unit 210 determines which direction of up, down, left and right the toothbrush bristles are facing, and does not determine the precise posture of the toothbrush. Therefore, the x-axis deviation determination unit 230 including the terrestrial magnetism sensor 231 capable of measuring a degree of how far a toothbrush handle is deviated from a magnetic north direction is used so as to determine the posture of the toothbrush.

Figure 10:
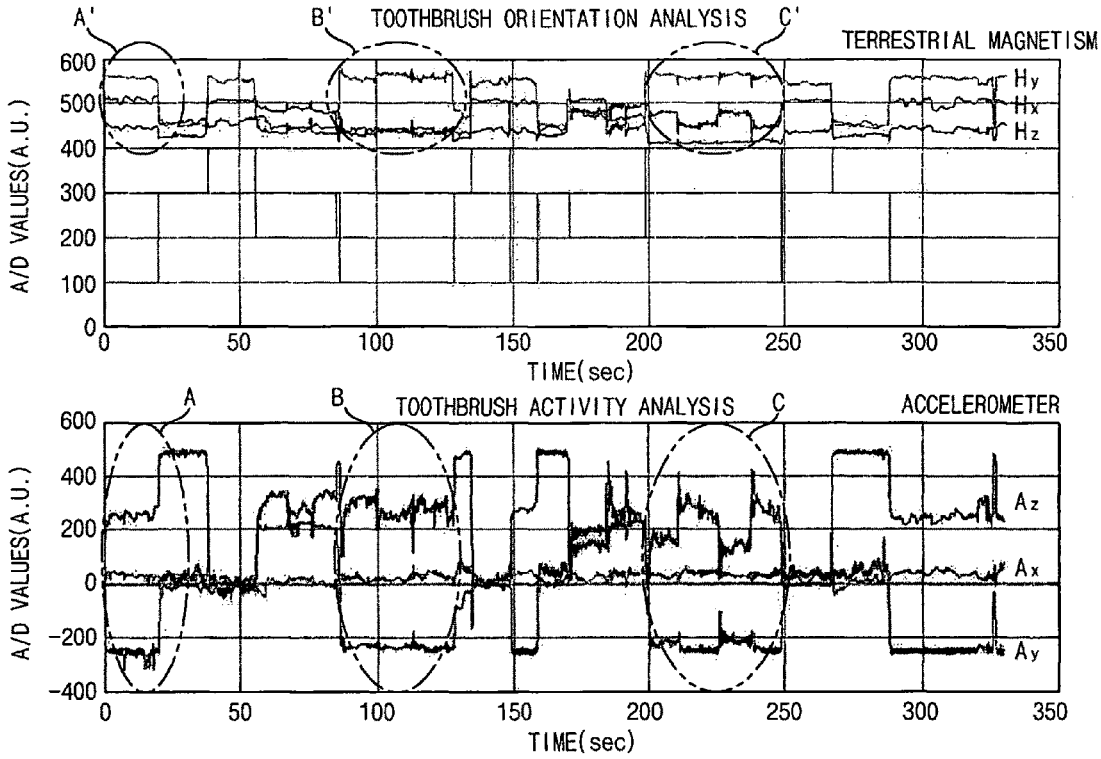
FIG. 10 is graphs showing outputs of a terrestrial magnetism sensor and an accelerometer for illustrating the posture of a toothbrush when the toothbrush is inclined to a left side as illustrated in FIG. 5.

FIG. 10 is graphs showing outputs of a terrestrial magnetism sensor and an accelerometer for illustrating the posture of a toothbrush when the toothbrush is inclined to a left side as illustrated in FIG. 5.

Referring to FIG. 10, A, B and C show output values of an accelerometer when toothbrush bristles are inclined to a left side as illustrated in FIG. 5 and A', B' and C' show output values of a terrestrial magnetism sensor when the toothbrush bristles are inclined to the left side as illustrated in FIG. 5. At A, B and C, the toothbrush bristles face substantially the same direction, and thus all of Ax, Ay and Az that are output values of the accelerometer show similar level values to one another; however, at A', B' and C', Hx and Hz that are output values of the terrestrial magnetism sensor show different level values from each other. That is, in a state in which the toothbrush bristles face to the left side, a toothbrush posture in which a toothbrush brushes an outer surface of front teeth is determined at A, the toothbrush posture in which the toothbrush brushes an outer surface of left molars is determined at B, and the toothbrush posture in which the toothbrush brushes an inner surface of right molars is determined at C.

Figure 6:
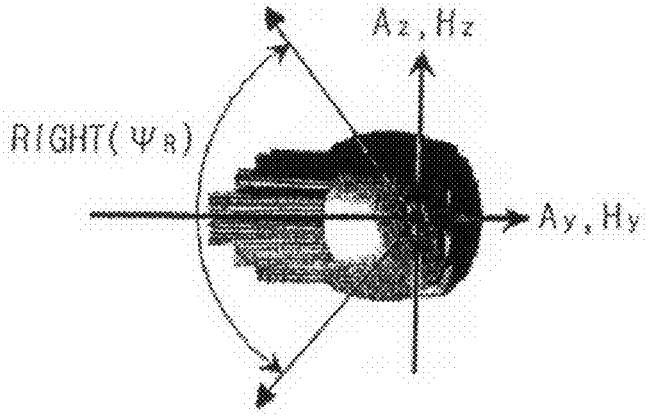
Figure 11:
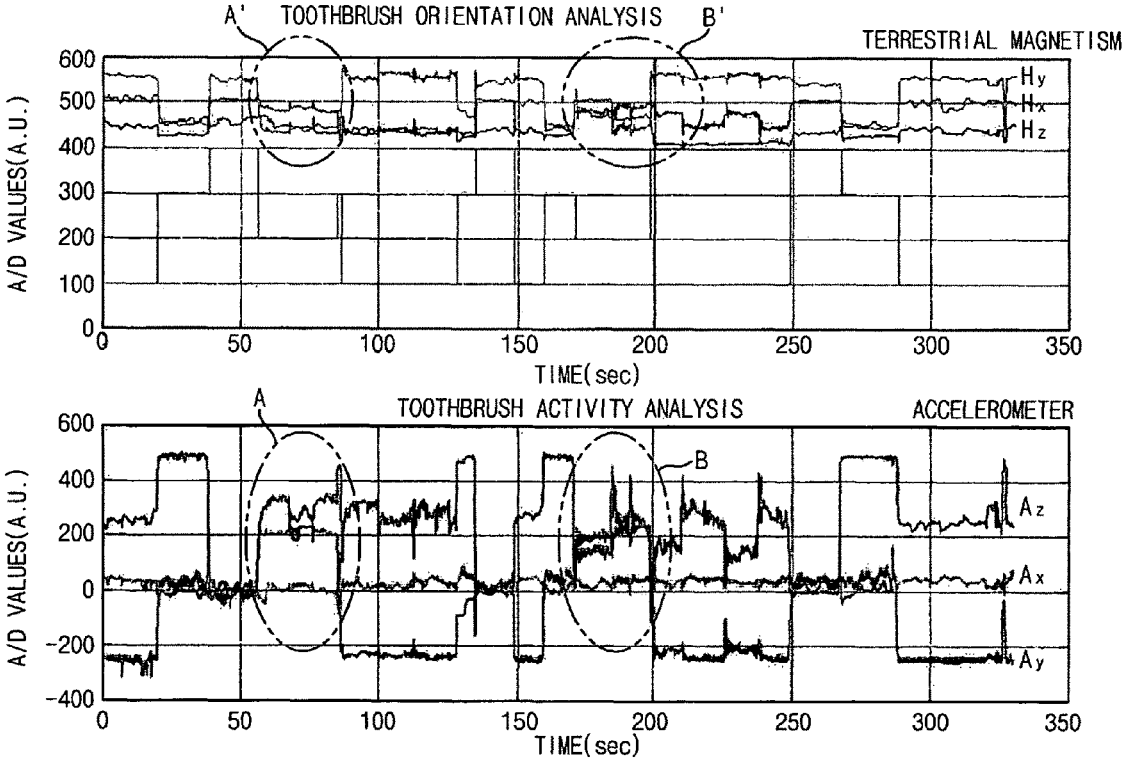
FIG. 11 is graphs showing outputs of a terrestrial magnetism sensor and an accelerometer for illustrating the posture of a toothbrush when the toothbrush is inclined to a right side as illustrated in FIG. 6.

FIG. 11 is graphs showing outputs of a terrestrial magnetism sensor and an accelerometer for illustrating the posture of a toothbrush when the toothbrush is inclined to a right side as illustrated in FIG. 6.

Referring to FIG. 11, A, and B show output values of an accelerometer when toothbrush bristles are inclined to a right side as illustrated in FIG. 6 and A' and B' show output values of a terrestrial magnetism sensor when the toothbrush bristles are inclined to the right side as illustrated in FIG. 6. At A and B, the toothbrush bristles face substantially the same direction, and thus all of Ax, Ay and Az that are the output values of the accelerometer show similar level values to one another; however, at A' and B', Hy and Hz that are the output values of the terrestrial magnetism sensor show different level values from each other. That is, the level values of Hy and Hz at B' are higher than the level values of Hy and Hz at A'. This means that a toothbrush is more bent toward the inside of an oral cavity at B' than at B'. That is, in a state in which the toothbrush bristles face to the right side, a toothbrush posture that the toothbrush brushes a right molar tooth outside is determined at A', and the toothbrush posture that the toothbrush brushes a left molar tooth inside is determined at B'.

Figure 7:
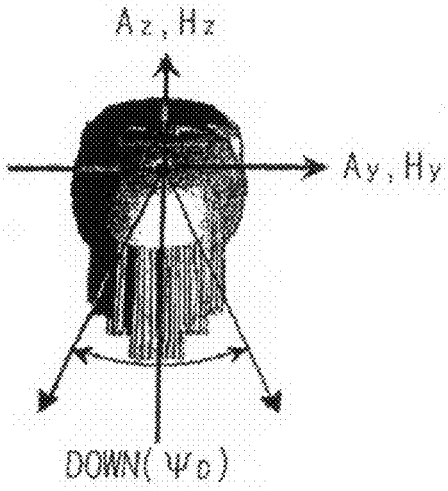
Figure 8:
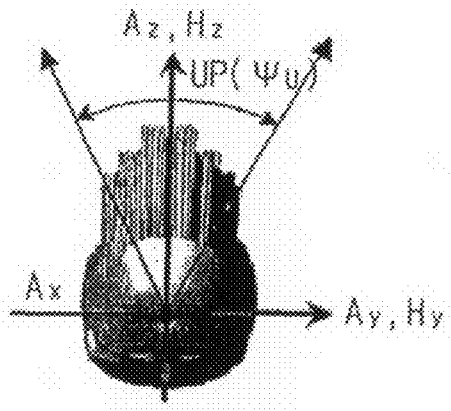
Figure 12:
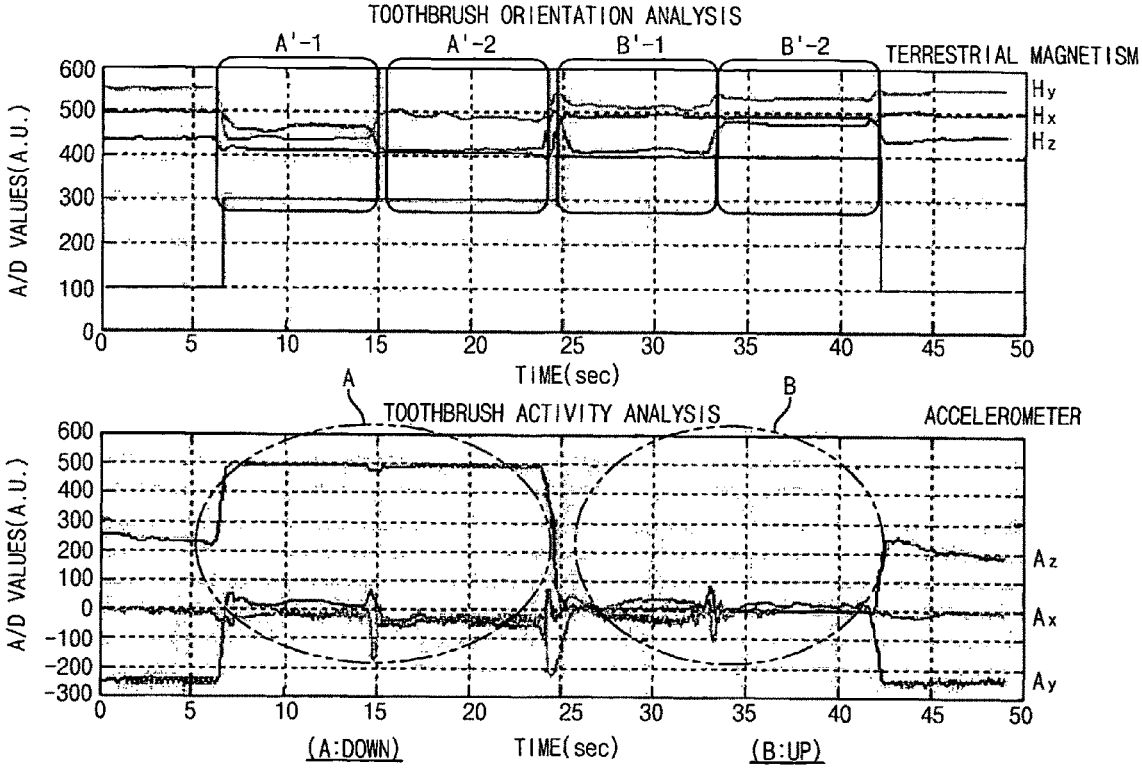
FIG. 12 is graphs showing outputs of a terrestrial magnetism sensor and an accelerometer for illustrating the posture of a toothbrush when the toothbrush is inclined to a lower side as illustrated in FIG. 7 and an upper side as illustrated in FIG. 8.

FIG. 12 is graphs showing outputs of a terrestrial magnetism sensor and an accelerometer for illustrating the posture of a toothbrush when the toothbrush is inclined to a lower side as illustrated in FIG. 7 and an upper side as illustrated in FIG. 8.

Referring to FIG. 12, A shows output values of an accelerometer and a terrestrial magnetism sensor when toothbrush bristles are inclined to the lower side as illustrated in FIG. 7 and B shows output values of the accelerometer and the terrestrial magnetism sensor when the toothbrush bristles are inclined to the upper side as illustrated in FIG. 8. At A and B, output values of the accelerometer are different from each other, and thus whether the toothbrush is facing the upper side or the lower side is determined. However, output values of the accelerometer are similar when the toothbrush faces the upper side, and thus which portion of teeth is brushed may not be detected by only the accelerometer. However, in a case of A, the toothbrush faces the upper side, the output values of the terrestrial magnetism sensor are different from each other at A'-1 and A'-2, and thus whether the lower surface of upper left molars 12 is brushed or the lower surface of upper right molars 6 is brushed is determined. Similarly, in a case of B, the toothbrush faces the lower side, the output values of the terrestrial magnetism sensor are different from each other at B'-1 and B'-2, and thus whether the upper surface of lower left molars 9 is brushed or the upper surface of lower right molars 3 is brushed is determined.

Figure 13:
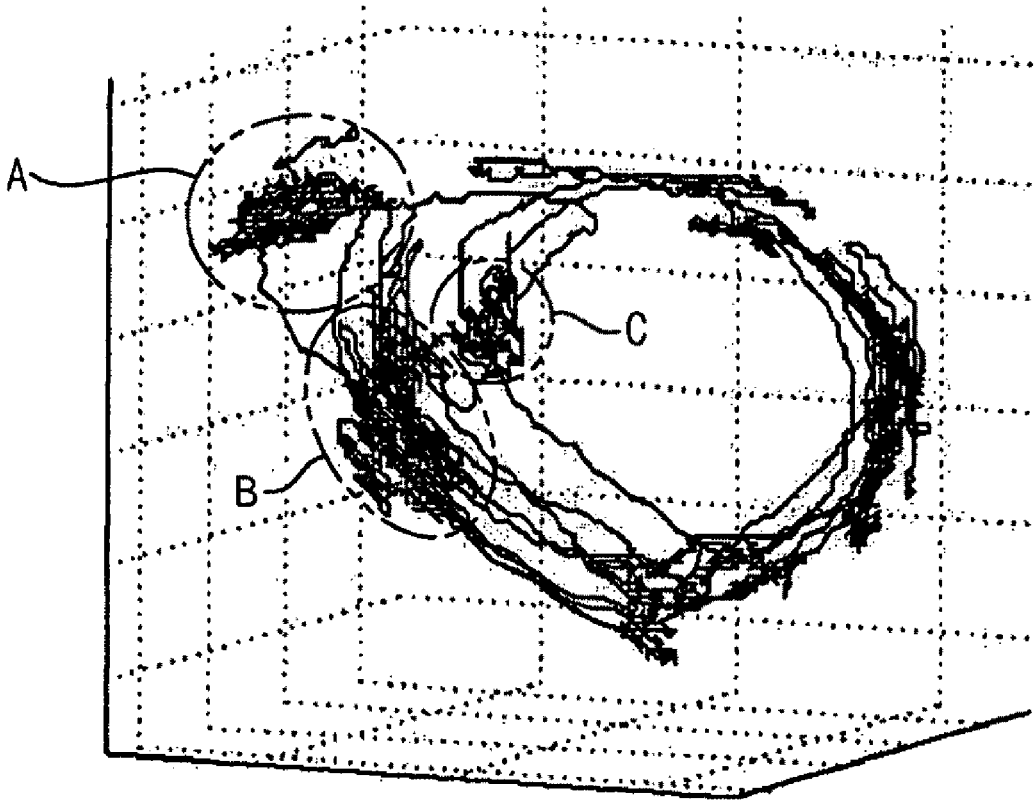
FIG. 13 is a three-dimensional graph illustrating an output of a terrestrial magnetism sensor when a toothbrush is inclined to a left side as illustrated in FIG. 5.

FIG. 13 is a three-dimensional graph illustrating an output of a terrestrial magnetism sensor when a toothbrush is inclined to a left side as illustrated in FIG. 5.

Referring to FIG. 13, when a user brushes in a state in which a toothbrush is inclined to a left side, clusters divided from one another are formed according to direction information detected by a terrestrial magnetism sensor.

A method of automatically dividing the clusters includes fuzzy clustering, a neural network and a k-means algorithm and so on. The following Equation 2 represents an equation of the k-means algorithm that is one of methods of dividing clusters.

$$\sum_{j=1}^{C}\sum_{k\in A}\|\vec{x}_k-\vec{v}_i\|^2 \qquad \text{[Equation 2]}$$

$$\vec{v}_i=\frac{\sum_{k=1}^{N_i}\vec{x}_k}{N_i},\ \vec{x}_k\in A_i$$

(Ai denotes a data value of an i-th cluster, vi denotes an average value of i-th cluster data, Ni denotes the number of data in Ai)

Output data of the terrestrial magnetism sensor are classified by forming a cluster, and thus the determination unit 250 may more efficiently determine the posture of a toothbrush. Therefore, which portion of teeth is brushed by toothbrush bristles may be more easily known.

Figure 14:
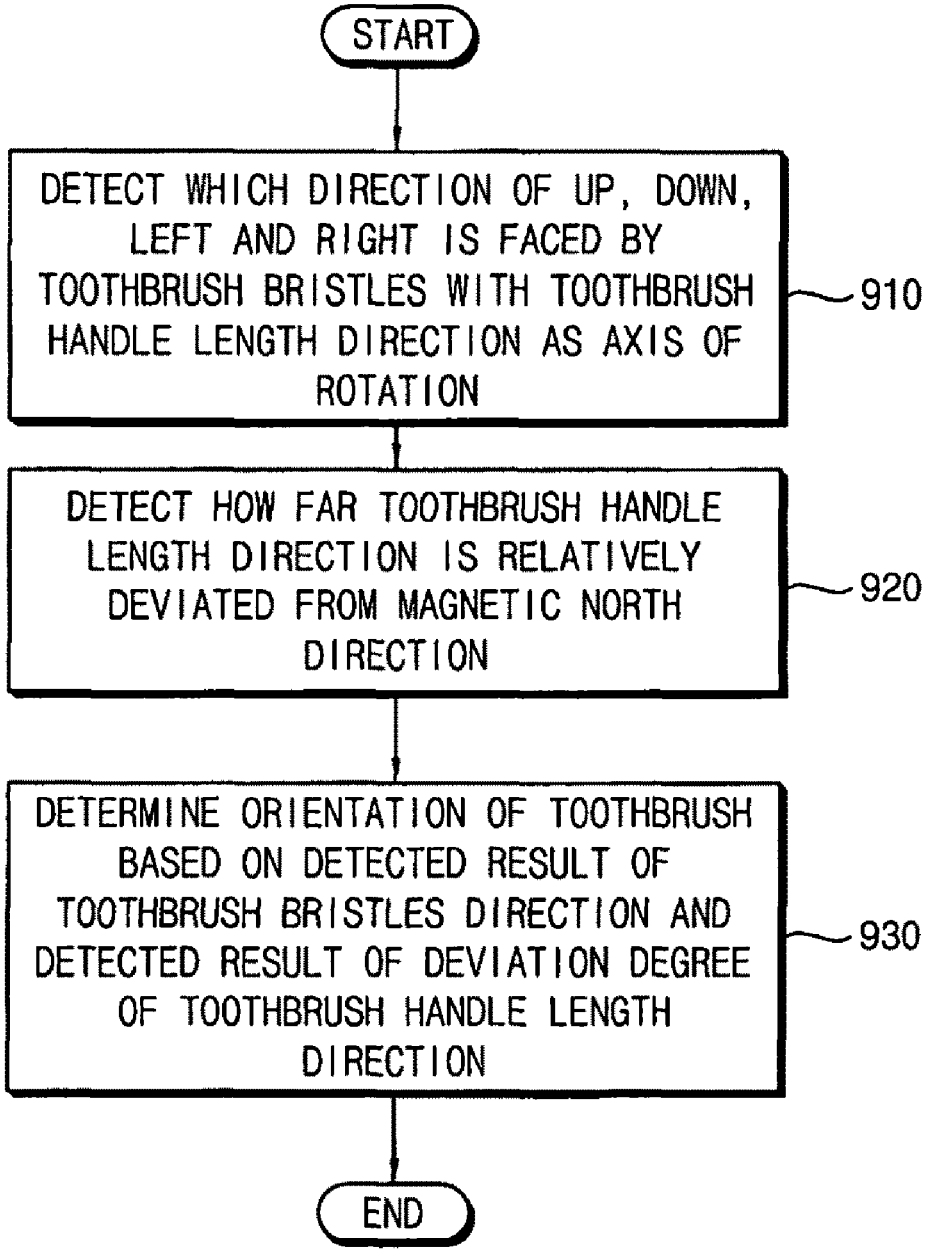
FIG. 14 is a flowchart for illustrating a method of tracking the posture of a toothbrush according to an example embodiment of the present invention.

FIG. 14 is a flowchart for illustrating a method of tracking the posture of a toothbrush according to an example embodiment of the present invention.

Referring to FIG. 14, a method of tracking the posture of a toothbrush according to an example embodiment of the present invention includes tracking the posture of a toothbrush having a triaxial direction of a toothbrush bristle direction, a toothbrush handle length direction perpendicular to the toothbrush bristle direction in a first virtual plane including the axis of the toothbrush bristle direction and a toothbrush bristle shaking direction perpendicular to the toothbrush handle length direction in a second virtual plane including the toothbrush handle length direction, in a three-dimensional space. According to the method of tracking the posture of the toothbrush, a state of which direction of up, down, left and right toothbrush bristles are facing with the toothbrush handle length direction as an axis of rotation is detected in real time using a triaxial accelerometer (step 910). How far the toothbrush handle length direction is relatively deviated from a magnetic north direction is detected in real time using a terrestrial magnetism sensor having the triaxial direction (step 920). The posture of the toothbrush is determined according to an inclined degree of the toothbrush in a specific direction based on the detected signal of the state of which toothbrush bristles are inclined and the detected deviation signal of the toothbrush handle length direction (step 930).

Therefore, an apparatus for tracking the posture of a toothbrush, and a method of tracking the posture of a toothbrush may track the posture of a toothbrush according to a toothbrushing of a user, using a triaxial accelerometer and a terrestrial magnetism sensor. Accordingly, the user may determine which portion of teeth is brushed, and the determined result may be used in analyzing a toothbrushing movement of the user by being applied to an apparatus for analyzing the toothbrushing movement.

As illustrated above, an apparatus for tracking the posture of an object is applied to an apparatus for tracking the posture of a toothbrush according to a toothbrushing of a user so as to help in understanding the present invention. However, the apparatus for tracking the posture of the toothbrush is only an example and the apparatus for tracking the posture of the object may be applied to an apparatus for monitoring a robot arm in a robot operation, as well as in various fields involving tracking the posture of a portion of an object and a human body, in addition to the apparatus for tracking the posture of the toothbrush.

INDUSTRIAL APPLICABILITY

An apparatus for tracking the posture of a moving object may track a toothbrushing movement of a user by being applied to an apparatus for tracking the posture of a toothbrush, and a method of tracking the posture of a toothbrush, and by detecting the posture of the toothbrush according to a toothbrushing of the user. Therefore, the tracked toothbrushing movement may be used in analyzing the toothbrushing movement of the user by being applied to an apparatus for analyzing the toothbrushing movement. Also, the apparatus for tracking the posture of the moving object may increase the accuracy of a robot operation by being applied to an apparatus for monitoring a robot arm in a robot operation and the apparatus for tracking the posture of the moving object may be applied to various fields involving tracking the posture of a portion of an object and a human body.

Having described the example embodiments of the present invention and its advantages, it is noted that various changes, substitutions and alterations can be made herein without departing from the spirit and scope of the invention as defined by appended claims.

The invention claimed is:

1. An apparatus for tracking a posture of a moving object in a three-dimensional space having a z-axis facing a reference surface of the moving object, an x-axis perpendicular to the z-axis in a virtual vertical plane including the z-axis, and a y-axis perpendicular to the x-axis in a virtual horizontal plane including the x-axis, the apparatus comprising:

a reference surface direction determination unit configured to detect which direction of up, down, left and right the reference surface is facing with the x-axis as an axis of rotation by using a roll angle of the reference surface that is amended according to a variation of a pitch angle of the reference surface from gravity;

an x-axis deviation determination unit configured to detect how far an x-axis direction of the moving object is relatively deviated from a magnetic north direction;

a sorter configured to sort output data of a terrestrial magnetism sensor; and a posture determination unit configured to determine the posture of the moving object based on how far the x-axis of the moving object is deviated and which direction of up, down, left and right the reference surface is facing in response to detection signals of the reference surface direction determination unit and the x-axis deviation determination unit.

2. The apparatus for claim 1, wherein the reference surface direction determination unit includes a triaxial accelerometer and the x-axis deviation determination unit includes the terrestrial magnetism sensor.

3. The apparatus for claim 1, wherein the sorter performs one of fuzzy clustering, a neural network and a k-means algorithm.

4. A method of tracking a posture of a moving object in a three-dimensional space having a z-axis facing a reference surface of the moving object, an x-axis perpendicular to the z-axis in a virtual vertical plane including the z-axis, and a y-axis perpendicular to the x-axis in a virtual horizontal plane including the x-axis, the method comprising:

detecting which direction of up, down, left and right the reference surface is facing with the x-axis as an axis of rotation by using a roll angle of the reference surface that is amended according to a variation of a pitch angle of the reference surface from gravity;

detecting how far an x-axis direction of the moving object is relatively deviated from a magnetic north direction;

sorting output data of a terrestrial magnetism sensor; and determining the posture of the moving object based on how far the x-axis of the moving object is deviated and which direction of up, down, left and right the reference surface is facing in response to the detected reference surface direction detection signal and the detected x-axis deviation detection signal.

5. An apparatus for tracking a posture of a toothbrush in a three-dimensional oral cavity having a direction toothbrush bristles are facing, a toothbrush handle length direction perpendicular to the direction the toothbrush bristles are facing in a virtual vertical plane including an axis of the direction the toothbrush bristles are facing, and a toothbrush bristle shaking direction perpendicular to the toothbrush handle length direction in a virtual horizontal plane including the toothbrush handle length direction, the apparatus comprising:

a triaxial accelerometer configured to detect which direction of up, down, left and right in an oral cavity the toothbrush bristles are facing with the toothbrush handle length direction as an axis of rotation by using a roll angle of the reference surface that is amended according to a variation of a pitch angle of the reference surface from gravity;

a terrestrial magnetism sensor configured to detect how far the toothbrush handle length direction is relatively deviated in the oral cavity from a magnetic north direction;

a sorter configured to sort output data of the terrestrial magnetism sensor; and a determination unit configured to determine which tooth portion is currently being brushed by the toothbrush bristles by determining how far a toothbrush handle of the toothbrush is relatively deviated from the magnetic north direction and which direction of up, down, left and right the toothbrush bristles are facing in response to detection signals of the triaxial accelerometer and the terrestrial magnetism sensor.

6. The apparatus for claim 5, wherein the determination unit determines by dividing teeth into 16 tooth portions, the tooth portions comprising: an outer surface of lower front teeth, an inner surface of lower front teeth, an outer surface of lower left molars, an inner surface of lower left molars, an upper surface of lower left molars, an outer surface of lower right molars, an inner surface of lower right molars, an upper surface of lower right molars, an outer surface of upper front teeth, an inner surface of upper front teeth, an outer surface of upper left molars, an inner surface of upper left molars, a lower surface of upper left molars, an outer surface of upper right molars, an inner surface of upper right molars, a lower surface of upper right molars.

7. A method of tracking a posture of a toothbrush in a three-dimensional oral cavity having a direction toothbrush bristles are facing, a toothbrush handle length direction perpendicular to the direction the toothbrush bristles are facing in a virtual vertical plane including an axis of the direction the toothbrush bristles are facing, and a toothbrush bristle shaking direction perpendicular to the toothbrush handle length direction in a virtual horizontal plane including the toothbrush handle length direction, the method comprising:

detecting which direction of up, down, left and right in an oral cavity the toothbrush bristles are facing with the toothbrush handle length direction as an axis of rotation, using a triaxial accelerometer by using a roll angle of the reference surface that is amended according to a variation of a pitch angle of the reference surface from gravity;

detecting how far the toothbrush handle length direction is relatively deviated in the oral cavity from a magnetic north direction, using a terrestrial magnetism sensor;

sorting output data of the terrestrial magnetism sensor; and determining which tooth portion is currently being brushed by the toothbrush bristles by determining how far a toothbrush handle of the toothbrush is relatively deviated from the magnetic north direction and which direction of up, down, left and right the toothbrush bristles are facing in response to detection signals of the triaxial accelerometer and the terrestrial magnetism sensor.

* * * * *